US005189854A

United States Patent [19]

Nebel

[11] Patent Number: 5,189,854

[45] Date of Patent: Mar. 2, 1993

[54] ADJUSTABLE HEIGHT STAIRWAY

[75] Inventor: Kyle J. Nebel, Macomb, Mich.

[73] Assignee: The United States of America as represented by the Secretary of the Army, Washington, D.C.

[21] Appl. No.: 944,600

[22] Filed: Sep. 14, 1992

[51] Int. Cl.[5] ..... E04F 11/00

[52] U.S. Cl. ..... 52/183; 182/1

[58] Field of Search ..... 52/109, 177, 180, 183, 52/188; 182/1

[56] References Cited

U.S. PATENT DOCUMENTS

| | | | |
|---|---|---|---|
| 4,593,503 | 6/1986 | Koslowski | 52/183 |
| 4,768,617 | 9/1988 | Mason et al. | 182/1 |
| 4,959,935 | 10/1990 | Stob | 52/183 |
| 4,971,168 | 11/1990 | Stanescy | 182/1 |

*Primary Examiner*—Richard E. Chilcot, Jr.
*Assistant Examiner*—Creighton Smith
*Attorney, Agent, or Firm*—Peter A. Taucher; David L. Kuhn

[57] ABSTRACT

The invention is an adjustable height stairway having two parallel elongate lower frame members and two parallel elongate upper frame members swingable on a base. The upper frame members have wave-like edges that can fit with complimentary wave-like edges on the lower frame members. A set of steps parallel to the base has pivotal connections to each frame member at peaks of the wave-like edges. At a first angular position, the stairway is in a collapsed configuration wherein the pivotal connections are coplanar and the steps lie in a common plane to form a runway. In a second angular position the stairway is in an expanded configuration form a ladder or set of stairs.

15 Claims, 3 Drawing Sheets

ADJUSTABLE HEIGHT STAIRWAY

GOVERNMENT USE

The invention described herein may be manufactured, used and licensed by or for the U.S. Government for governmental purposes without payment to me of any royalty.

BACKGROUND AND SUMMARY

The U.S. Army uses a turret motion base simulator to move a turret detached from its armored vehicle as if the turret were actually on the vehicle during travel over various terrains. To install a turret on the simulator, it is necessary to have a work platform at the testing station disposed at the height of the turret. The platform needs an access stairway so that workmen carrying tool boxes or test equipment can get to the platform from the ground. Since the U.S. Army tests turrets of varying configurations, it is helpful and often necessary to raise and lower the platform to better adapt the platform to a given turret. Consequently, the U.S. Army needs a stairway that moves with the platform but still allows workmen to carry heavy or bulky objects between the ground and the platform.

I have devised an adjustable stairway which can both rise with the platform and form either an inclined or a horizontal ramp suitable for wheeled carts. My stairway comprises two parallel upper frame members swingable about a first axis and two parallel lower frame members swingable about a second axis. A set of horizontal steps are pivotally connected to the frame members and normally remain parallel as the stairway swing up and down about the axes. When the frame members reach a horizontal position, the stairway is collapsed such that the steps are aligned in a common plane to form a runway. The connection between the base and the upper frame members can be released so that the steps can be swung into the common plane when the frame members are not horizontal, whereby the stairway forms an inclined ramp.

DETAILED DESCRIPTION

Figures 1, 2:
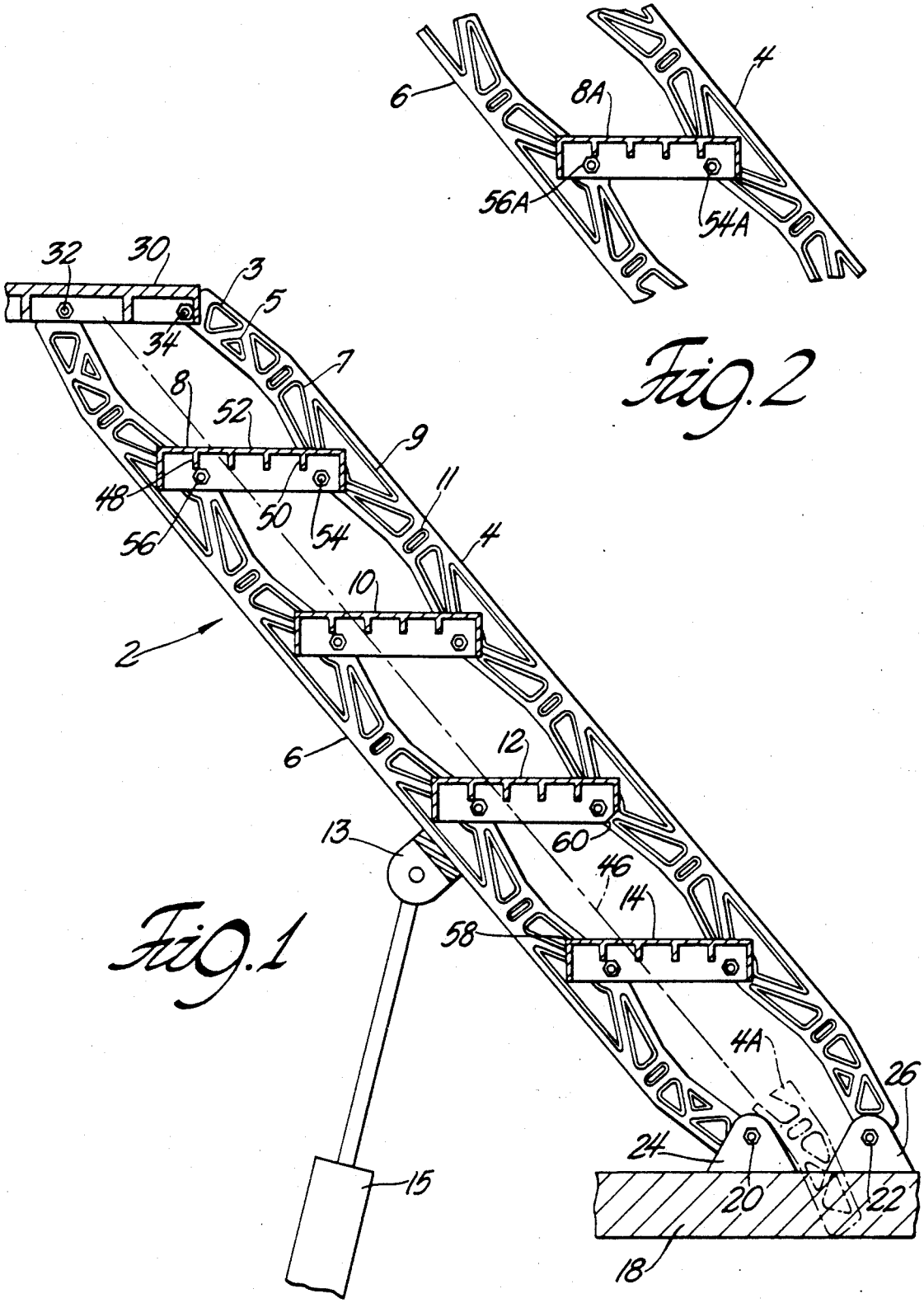
FIG. 1 is a sectioned side elevational view of my adjustable height stairway.
FIG. 2 is a partial sectioned side view showing a slight variation in structure for a step mounted on the stairway.
Figure 4:
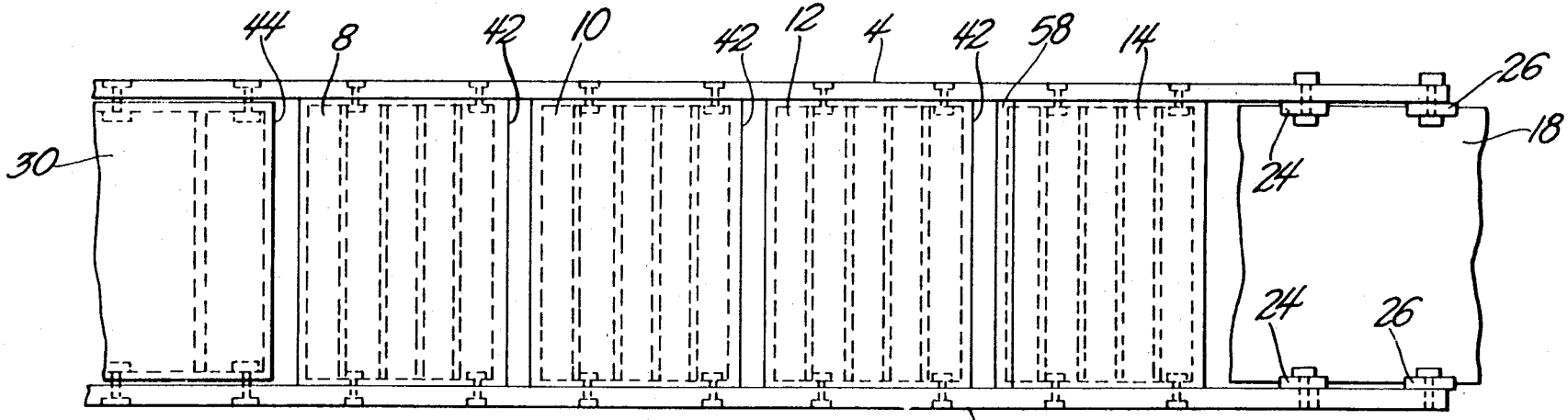
FIG. 4 is a top elevational view of the stairway in the collapsed, horizontal configuration with the tops of the step aligned in a common horizontal plane.

FIG. 1 is a sectioned view showing one half of adjustable height stairway 2 in a raised position. The figure shows one upper frame member 4 of a pair of upper frame members and shows one of two lower frame members 6. The upper and lower frame members are identical, the upper frame member turned 180 degrees in the plane of FIG. 1 relative to the lower frame member. Pivotally connected between upper frame member 4 and lower frame member 6 are a set of horizontal steps 8, 10, 12 and 14. It will be understood that stairway 2, when fully assembled, has a second upper frame member 16 (FIG. 4) and a second lower frame member. These latter frame members, if shown in FIG. 1, would congruently overlie the frame members shown in that figure, and would engage the sides of the steps facing the viewer in the figure.

The frame member define a plurality of shallow recesses whose purpose is to reduce the members' weight. Some of the recesses are generally triangular in shape as at 3, 5, 7 and 9 and other recesses have elongate shapes, as at 11. The sides of the frame members facing away from the viewer in FIG. 1 are flat. It may be preferred in some applications for the flat sides of the frame members to face toward the steps. Such an arrangement reduces the chance of scissoring or entrapping a portion of a person's foot as the person ride stairway 2 when it rises or lowers.

Frame members 4 and 6 are rotatably secured to mounts 24 and 26 by means of bolts 20 and 22, and the mounts are affixed to base 18. The frame members are similarly pivotally secured to platform 30 by bolts 32 and 34. Base 18 and platform 30 are parallel to the set of horizontal steps whereby the base and platform act as landings for stairway 2. Any conventional means may be used to swing stairway 2 about amount 24 and 26, such as hydraulic cylinder 16 having pivotal connection 13 with the stairway.

As stairway 2 swings counterclockwise and downward in FIG. 1, the base, steps and platform remain mutually parallel and frame member 4 closes with frame member 6. When the stairway reaches the horizontal position, upper frame member 4 will nest upon lower frame member 6 as seen in FIG. 2. Bolt holes 36 (FIG. 3) of the upper frame member and bolt holes 38 of the lower frame member are aligned in a single horizontal plane and the tops of the steps are aligned in another, parallel plane represented by line 40. As perhaps best seen in FIG. 4, the steps 8, 10, 12 and 14 will be close together, having gaps 42 of preferably one inch or less between them, whereby the steps form a runway or ramp for wheeled carts. Step 8 will define a similar gap 44 with platform 30, whose top lies in plane 40 along with the tops of the steps. A portion of upper frame members 4 and 16 will extend above plane 40 so that the steps and upper frame members define a shallow rectangular channel capable of guiding wheeled carts in a straight line along the tops of the steps and keeping such carts from rolling off the steps.

Figure 3:
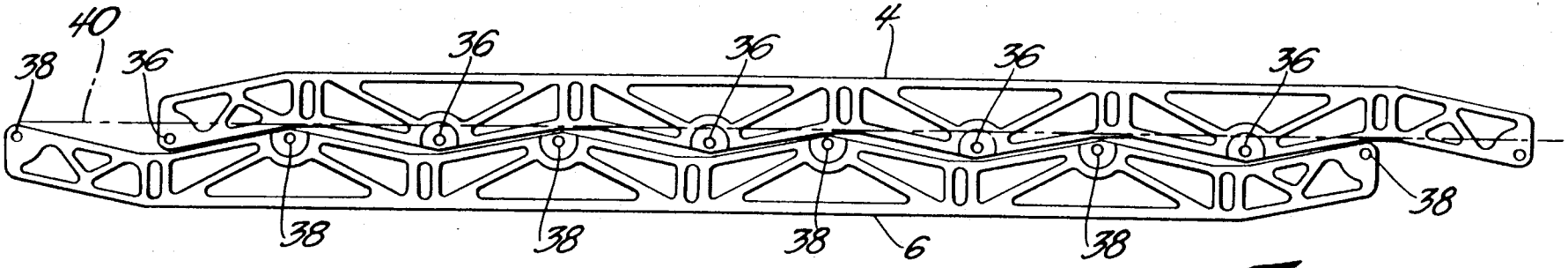
FIG. 3 is a side elevational view of the frame members of my stairway in a collapsed position, the steps and other structure of the stairway being omitted from this view for clarity.

Referring again to FIG. 1, removal of bolt 26 will allow stairway 2 to collapse whereby the bottom of upper frame member 4 will move to the position designated at 4A, whereby the upper and lower frame member will nest in a manner similar to that shown in FIG. 3. Base 18 is shaped to avoid interference with the bottom of upper frame member 4 as that member moves to engage lower frame member 6. After removal of bolt 26, platform 30 and the steps swing clockwise downward into a common inclined plane 46 until frame member 4 nests with frame member 6, whereby stairway 2 forms a ramp suitable for wheeled carts or dollies. A portion of upper frame member 4 will extend above common inclined plane so that the steps and upper frame members form a guide channel for the carts and dollies.

It is contemplated that the weight of a person's foot on a step will be born principally by central zone 52 (FIG. 1) between supports 48 and 50. The axis of pivot pin or bolt 56 is within zone 52 at the rear portion thereof, whereas the axis of pivot pin or bolt 54 is forward of the zone. The juxtaposition of bolts 54 and 56 to zone 52 causes bolts 56 to bear a higher proportion of the weight of a person's foot on the step. This will be preferred at least in some cases because bolt 56 has a greater mass of material supporting it than does bolt 54. A variant of step 8 is step 8*a* in FIG. 2 wherein the axes of both bolts 54A and 56A are outside central zone 52A.

Step 12 in FIG. 1 is a slight variation of step 8 since step 12 defines a bevel 60 at its lower front corner. The purpose of bevel 60 is to provide greater clearance between the front of step 12 and upper rear corner 58 of step 14 when these steps swing clockwise on frame member 6 in FIG. 1. This greater clearance permits gap 42 (FIG. 4) between steps 14 and 12 to be narrowed when the steps are disposed along plane 40 (FIG. 3), whereby a more nearly continuous ramp surface is formed by the steps.

Figure 5:
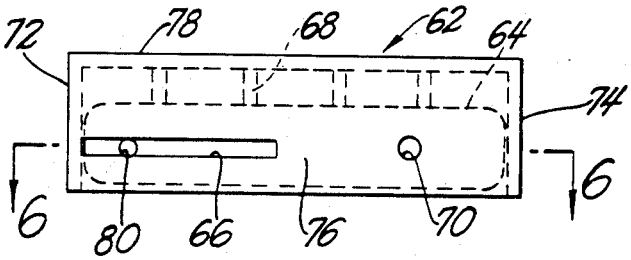
FIG. 5 is a side elevational view of an alternate embodiment of a step for the stairway.
Figure 6:
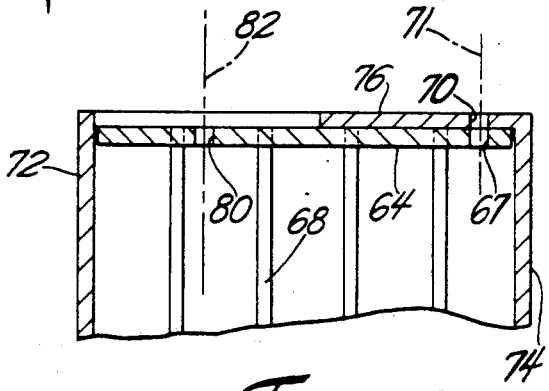
FIG. 6 is a view taken along ling 6—6 in FIG. 5.

In FIGS. 5 and 6 is shown step 62, which is an alternate embodiment of step 8. Step 62 has a top plate 78 to which are integrally connected front wall 72, rear wall 74, opposed side walls 76, and internal ribs 68. Side walls 76 each define an elongate slot 66 and a hole 70 aligned with the longitudinal axis of slot 66. Bearing on the inner surface of end wall 76 is a flat bar 64 defining a first aperture 67 aligned with hole 70 on hole axis 71 and a second aperture 80 whose aperture axis 82 passes perpendicularly through slot 66. Preferably flat bar 64 bears against walls 72 and 74 and the bottoms of ribs 68 so that these walls and ribs can be used to locate bar 64 in step 62. The forward pivot axis of step 62 is axis 82 and this axis can be moved relative to step 62 by replacing bar 64. The replacement bar will have a different distance between apertures 67 and 80 than the distance shown in FIGS. 5 and 6, whereby the position of axis 82 relative to slot 66 will differ.

Figure 7:
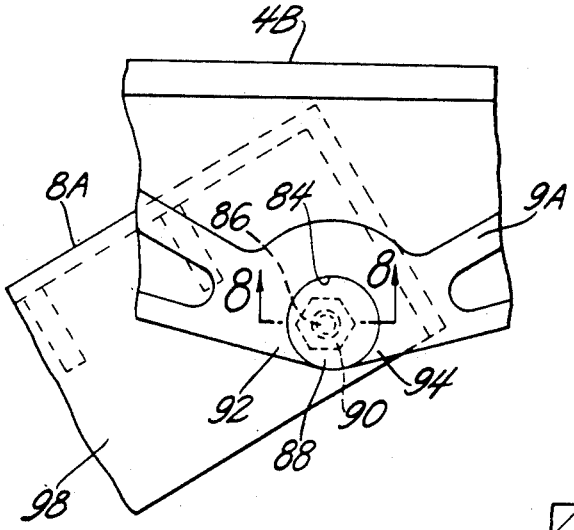
FIG. 7 is a detail view of an alternate connecting means for pivotally fastening a step to an upper frame member of may stairway.
Figure 8:
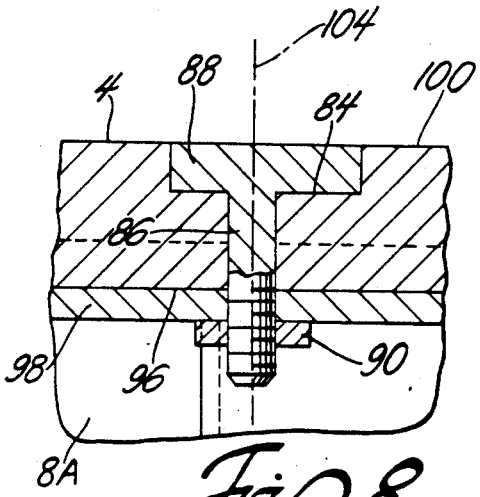
FIG. 8 is a view taken along line 8—8 in FIG. 7.

FIG. 7 is a detail view showing an alternate means by which a step can be pivotally connected to an upper frame member. In that figure, upper frame member 4B has its shallow recesses such as 9A faced away from step 8A and has a flat surface 96 bearing slidably against end wall 98 of step 8A. At the outer surface 100 of frame member 4B is a flat, shallow, generally circular recess 84, which is open along an acute-angle sector. Adjacent this sector beneath bolt head 88 are wedge shaped edges 92 and 94 which support the bolt head. Recess 84 closely receives bolt head 88, which is eccentrically affixed to bolt shaft 86, whereby shaft 86 is prevented from rotating about axis 104 when head 88 is in recess 84. Head 88 is flush with outer surface 100 of frame member 4B so that head 88 has no possibility of snagging objects against which frame member 4A brushes as it moves. Bolt shaft passes through end wall 98 of step 8A and is theadingly engaged by nut 90 inside the step.

I wish it to be understood that I do not desire to be limited to the exact details of construction shown and described herein since obvious modifications will occur to those skilled in the relevant arts without departing from the spirit and scope of the following claims.

I claim:

1. An adjustable height stairway comprising:

a base;

two parallel lower frame members having first base engagement ends;

first connection means for pivotally mounting the first base engagement ends to the base, the lower frame members swingable about the first connection means;

two parallel upper frame members having second base engagement ends;

second connection means for pivotally mounting the second base engagement ends to the base, the second connection means being remote from the first means, the upper frame members swingable about the second connection means;

a plurality of steps parallel to the base disposed at intervals along the lower frame members, each of the steps having one end and an opposed other end;

the one ends pivotally connected between one of the upper frame members and one of the lower frame members;

the other ends pivotally connected between another of the upper frame members and another of the lower frame members;

the frame members each including an elongate edge having a wave-like configuration comprised of alternating peaks and valleys, the elongate edges on the upper frame members faced toward the elongate edges on the lower frame members;

connection locations on the peaks where the steps are pivotally connected to the frame members;

means for swinging the stairway upon the first and second connection means;

the stairway having a collapsed configuration in which peaks of elongate edges of the lower frame members project into valleys on the upper frame members such that all the connection locations are coplanar and tops of the steps are in a common plane;

the stairway having a expanded configuration where the elongate edges of the upper frame members are spaced from the elongate edges of the lower frame members.

2. The stairway of claim 1 wherein the stairway moves from the collapsed configuration to the expanded configuration as the stairway is swung upward about the first and second connection means.

3. The stairway of claim 1 wherein the steps form a runway during the collapsed configuration.

4. The stairway of claim 3 wherein portions of the upper frame members protrude through the common plane at least during the collapsed configuration, the portions disposed along the runway such that the runway and the portions together define a cross-sectionally flat rectangular channel.

5. The stairway of claim 1 wherein the second connection means is a means for releasably and pivotally mounting the second base engagement ends to the base, whereby the stairway can assume the collapsed position while the lower frame members are inclined relative to the base.

6. The stairway of claim 1 wherein;

the one upper frame member has one flat surface facing another flat surface on the other upper frame member;

the one lower frame member has a first flat surface facing a second flat surface on the other lower frame member;

the flat surfaces slide against the end of the steps at the connection locations.

7. The stairway of the claim 1 further including:

tops of the stairs;

principle weight bearing zones at the middles of the tops for accepting the weight of persons on the steps, the principle weight bearing zones being closer to connection locations on the lower frame members than to connection locations on the lower frame members.

8. The stairway of claim 1 wherein the steps further comprise:

a top horizontal load bearing surface connecting the one ends with the other ends;

elongate slots defined by the ends, the slots being parallel to the load bearing surfaces;

apertures defined by the ends, the apertures aligned with longitudinal axes of the slots;

flat bars in the steps faced against the ends and removably attached thereto, the bars defining first holes aligned with the apertures and defining second holes at the elongate slots;

wherein the connection locations are at the holes.

9. The stairway of claim 1 further comprising:

an exterior surface on the one upper frame member, the exterior surface faced away from one of the ends of the steps, the exterior surface defining a flat, generally circular recess;

a head flush with the exterior surface fitting closely in the recess;

a shaft extending from the head through the one upper frame member and through the one end, the longitudinal axis of the shaft being eccentric relative to the head;

a nut at the end threadingly engaging portion of the shaft protruded through the one end.

10. The stairway of claim 1 wherein all the frame members have an identical configuration.

11. An adjustable height stairway comprising:

a base;

a lower frame member;

first connection means for pivotally mounting the lower frame member to the base;

an upper frame member parallel to the lower frame member;

second connection means for pivotally mounting the upper frame member to the base, the second connection means being remote from the first means;

steps parallel to the base and disposed along the frame members and having a pivotal connection with each of the frame members;

means for swinging the stairway upon the first and second connection means;

the stairway having a collapsed configuration in which the pivotal connections all lie in a single plane.

12. The stairway of claim 11 wherein the stairway moves toward the collapsed configuration as the stairway swings in a first angular direction and wherein the stairway moves away from the collapsed configuration as the stairway moves in a second angular direction.

13. The stairway of claim 12 wherein tops of the steps align in a common plane during the collapsed position so as to form a ramp.

14. The stairway of claim 13 wherein second connection means is a means for releasably and pivotally mounting the upper frame member to the base, whereby the stairway can form the ramp at a plurality of angular positions of the stairway when the second connection means is released.

15. The stairway of claim 11 wherein each of the steps further comprises:

an end of the step bearing slidably against the first frame member and the second frame member;

an elongate slot defined by the end;

an aperture defined by the end, the aperture aligned with a longitudinal axis of the slot;

a flat bar faced against the end and removably attached thereto, the bar defining a first hole aligned with the aperture and defining a second hole at the elongate slot;

wherein the connection locations are at the holes.

* * * * *